US005390466A

United States Patent [19]

Johnson et al.

[11] Patent Number: 5,390,466

[45] Date of Patent: Feb. 21, 1995

[54] BUILDINGS AND BUILDING COMPONENTS

[76] Inventors: Ronald K. Johnson, 402 Green St., Mount Horeb, Wis. 53572; William M. Garrison, 1802 Elka La., Madison, Wis. 53704

[21] Appl. No.: 862,813

[22] Filed: Apr. 3, 1992

[51] Int. Cl.[6] ..... E04C 2/34; E04B 2/00

[52] U.S. Cl. ..... 52/796; 52/790; 52/814; 52/821; 52/731.1; 52/309.16

[58] Field of Search ..... 52/309.14, 309.16, 309.7, 52/309.11, 317, 795, 806, 807, 808, 814, 785, 793, 809, 821, 726.1, 730.1, 731.1, 731.5, 731.9, 817, 790, 796

[56] References Cited

U.S. PATENT DOCUMENTS

| | | | |
|---|---|---|---|
| 3,184,013 | 5/1965 | Pavlecka | 52/793 |
| 3,834,096 | 9/1974 | Becker | 52/172 |
| 4,282,687 | 8/1981 | Teleskivi | 49/503 |
| 4,295,312 | 10/1981 | Campbell | 52/408 |
| 4,309,853 | 1/1982 | Lowe | 52/90 |
| 4,566,242 | 1/1986 | Dunsworth | 52/573 |
| 4,567,100 | 1/1986 | Pickett et al. | 428/339 |
| 4,571,915 | 2/1986 | Barman | 52/785 |
| 4,641,468 | 2/1987 | Slater | 52/309.4 |
| 4,741,139 | 5/1988 | Campbell | 52/796 X |
| 4,754,587 | 7/1988 | Glaser | 52/282 |
| 4,822,657 | 4/1989 | Simpson | 428/69 |
| 5,056,290 | 10/1991 | Alexander | 52/584 |

*Primary Examiner*—Carl D. Friedman
*Assistant Examiner*—Robert J. Canfield
*Attorney, Agent, or Firm*—Stroud, Stroud, Willink Thompson & Howard

[57] ABSTRACT

This invention provides bridge girt assemblies, and modular building panels, for use in fabricating walls and roofs of buildings. The panels have novel structures adapted to protect the interior of the building from intrusion of heat and cold, and/or from fire, and/or from small arms gunfire. Some embodiments also provide mechanical reinforcing connections between the building structural members and the outside of the building. The modular panels can be made entirely with noncombustible materials.

47 Claims, 5 Drawing Sheets

FIG. 2
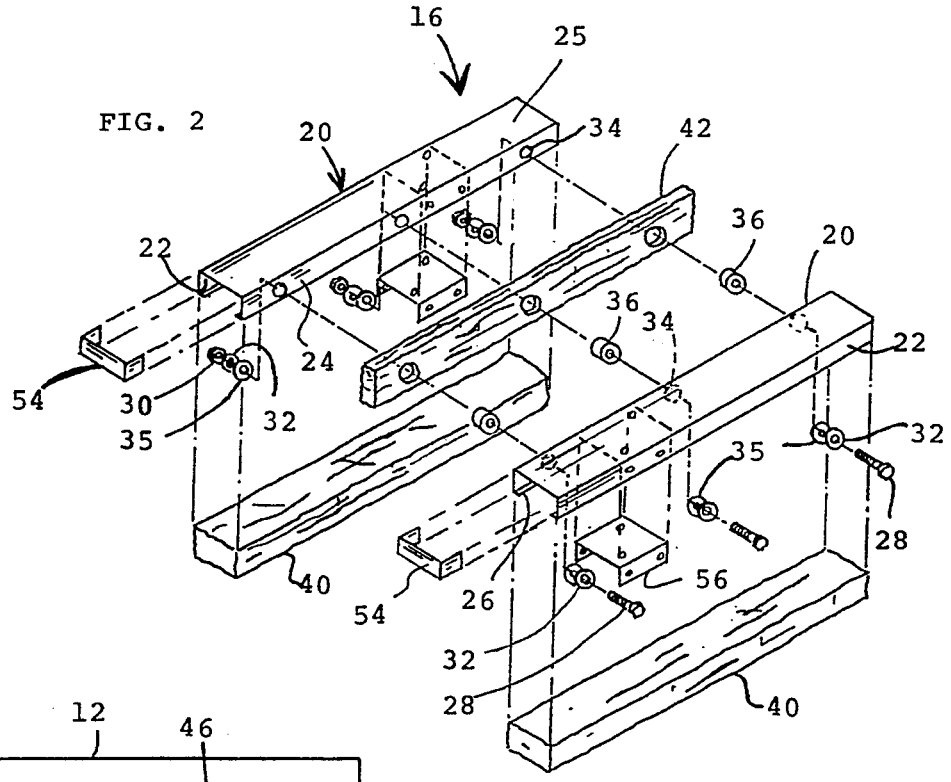
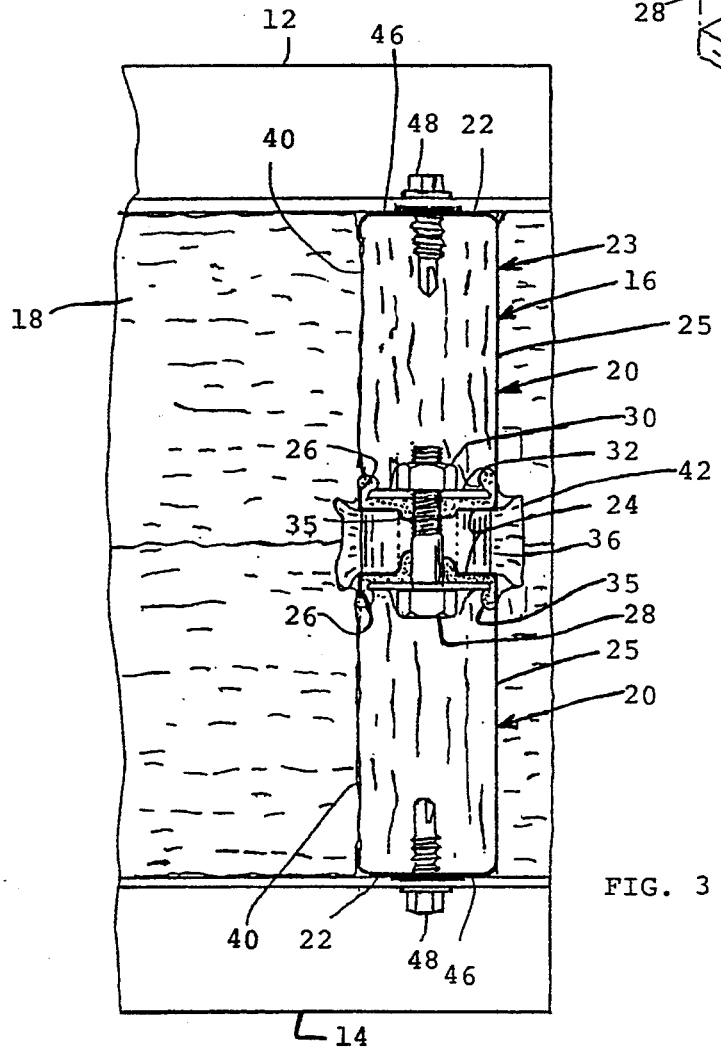
FIG. 3

BUILDINGS AND BUILDING COMPONENTS

TECHNICAL FIELD

This invention relates generally to construction materials, and specifically to modular building panels for use in buildings. The modular building panels disclosed herein can be used on either the exterior or the interior walls of buildings including roofs and floors. The panels of the present invention are particularly well suited for use for protection from fire, and from penetration of ballistic projectiles.

BACKGROUND OF THE INVENTION

Prefabricated, modular building panels generally are formed of a pair of spaced apart walls, surfaces, or skin sheets, having inserted therebetween some kind of insulating core material. In recent years, a variety of foamed polymers (e.g., polyurethane and polystyrene) have been used as the insulating core material for such modular building panels. Various problems, however, have been encountered in the design and structure of modular building panels. The industry has struggled to find ways to integrate, into a modular building panel, the combination of thermal insulation, mechanical strength desired for the panel, fire resistance and/or other desired properties.

There have been various prior art attempts to provide improved panels. For example, U.S. Pat. No. 4,641,469 issued to Wood teaches a modular panel made with polyurethane foam board or polystyrene foam board. Flanged rigidifying channels are inserted into the foam board by sliding them lengthwise into channels cut into, and extending across, the foam board. At the construction site, the board is attached to the building structural members by use of the rigidifying channels.

In U.S. Pat. No. 4,961,298 issued to Nogradi, "C-shaped" aluminum rigidifying channels are embedded into the foam board by transverse movement of the channels relative to the foam board, and are held to the board by adhesive. At the construction site, the board is glued to a substrate wall surface.

Both Wood and Nogradi teach using light-weight coatings on the board surfaces. Typical coatings are acrylic-based coatings or cementitious materials. Neither Wood nor Nogradi teach any reinforcing means extending between the two outer surfaces of the modular building panel. Accordingly, they are unable to provide any structural connection between the building structural members and the surfaces of the modular building panels which are disposed outwardly of the building. The panels of Wood and Nogradi lack the ability to secure heavy components, such as brick, on the outside surface of such modular panels to the structural members of the building, by connection through the elements of the modular panel. Accordingly, both the Wood and Nogradi panels lack mechanical strength. Neither do they offer a noncombustible insulating panel or protection from penetration of ballistic projectiles.

U.S. Pat. No. 4,837,999 issued to Stayner teaches a modular insulating panel made with a foam board core member, and having fiberglass-impregnated and/or filler-impregnated "C-shaped" or "H-shaped" thermoset resin pultrusions on opposing edges of the foam boards and extending between the inner and outer surfaces of the modular panel. The pultrusions in Stayner can perhaps provide a reinforcing connection between the building structural members and the outer surface of the building modular panels, while maintaining a reasonable thermal barrier between inner and outer surfaces of the modular panels at the pultrusions. But the polymer resin-based pultrusions inherently comprise a continuous-phase embedding polymeric material which receives the reinforcing fiberglass and/or any filler used. Accordingly, while the pultrusion may have a lower fire spread rate, it can contribute fuel to the burning of a fire. Of even greater concern, the polymer-based pultrusion can melt. Stayner makes no claim that his pultrusion is noncombustible or nonmelting. Rather, he suggests using noncombustible mineral wool for some or all of the core member of the modular panel, in order to reduce or eliminate combustibility of the core member. His only suggestion that offers elimination of the combustibility of the pultrusions is to replace the pultrusions with corresponding members made with metal. Stayner admits that such metal members would compromise the insulating value of the modular panels. He does not address the susceptibility of his polymer to melt. Stayner offers no mechanical reinforcing means and no bullet-proofing.

Thus, a persistent and vexatious problem in the art is the lack of a modular panel having the combination of good thermal insulation and mechanical properties, as well as maintenance of structural integrity during fire conditions; namely noncombustible and nonmelting properties, preferably including reinforcing connections between the building structural frame and the outer surface of the outer wall of the building. Neither does the art teach or suggest a modular building panel offering substantial protection from penetration of ballistic projectiles. Despite recognition of these design problems, proper solutions to these problems have not been demonstrated in the art.

SUMMARY OF THE INVENTION

This invention provides modular building panels for use in fabricating, for example, walls, floors and roofs of buildings. The panels typically are intended to protect the interior of the building from intrusion of heat and cold, from fire, and/or, in some embodiments, from small arms gunfire.

In a first embodiment, some aspects of the invention are obtained in a novel bridge girt assembly comprising first and second noncombustible, elongate brace members, each elongate brace member having an outer leg adapted to receive a modular building panel skin sheet thereon, and web means extending from each outer leg toward the other elongate brace member; and noncombustible, thermally insulating spacing means secured between the webs of the brace members; the noncombustible, thermally insulating spacing means providing a thermal break between the brace members, along the respective lengths thereof.

Preferably, the spacing means is substantially noncompressible along the dimension thereof which extends between the webs of the brace members.

In preferred versions of this embodiment, the spacing means comprises a plurality of spacers disposed at spaced locations along the lengths of the brace members. Preferred spacers are comprised of ceramic material which is adapted to withstand the compressive force applied to the spacers by applying 32 foot pounds of torque on standard coarse-thread machine bolts and using that torque, applied to the machine bolts, to secure the spacers in the assembly by compression. The ceramic spacers are typically secured between the webs of the brace members by connectors having negligible thermal insulating value. Where it is desired to ensure an effective thermal break, washers are placed between the connectors and the webs of the brace members, the washers being thermally insulating and noncombustible, and being compressible when assembled into the bridge girt assembly.

In preferred versions of the bridge girt assembly, the brace members can have cavities extending along their respective lengths, and insulation, preferably noncombustible insulation, can be disposed in the cavities.

The invention comprehends modular building panels, made with the above bridge girt assemblies of the first embodiment. A respective panel has a length, a width, and a thickness, and comprises a core panel means having edges and opposing major surfaces extending between the edges; first and second ones of the above bridge girt assemblies on opposing ones of the edges of the core panel means, the outer legs of the bridge girt assembly defining opposing outer surfaces adapted to receive inner and outer skin sheets of the modular panel; and inner and outer skin sheets extending across the major surfaces of the core panel means and secured to the first and second bridge girt assemblies at their opposing outer surfaces, such that the core panel means is disposed and secured between the inner and outer skin sheets and the first and second bridge girt assemblies.

Preferably, the core panel means and the skin sheets consist essentially of noncombustible materials, whereby the modular building panel is noncombustible, and the building panel has an overall insulating value of at least R2, preferably at least R3, per inch thickness of the core panel means.

In a second embodiment of bridge girt assemblies and modular building panels made therefrom, the bridge girt assembly comprises first and second elongate brace members, each elongate brace member having an outer leg adapted to receive a skin sheet thereon, and web means extending from each outer leg toward the other brace member; and a plurality of thermally insulating spacers, spaced from each other and secured between the web means, and thereby securing the first and second brace members to each other, the thermally insulating spacers, as assembled in the bridge girt assembly, providing a thermal break between the first and second elongate brace members.

As in the first bridge girt embodiment, the spacers are preferably substantially noncompressible, and comprise the above-described ceramic spacers secured between the webs by the above connectors having negligible thermal insulating value, the bridge girt assembly including the above thermally insulating, noncombustible washer means which is compressible when assembled into the bridge girt assembly.

In a third embodiment, the invention comprises a modular building panel, comprising a pair of facing skin sheets arranged with adjacent edges generally extending parallel to, and spaced apart from, one another, and defining a length and a width, and a space between the facing skin sheets; core panel means in the space between the facing skin sheets, and generally coextensive with the facing skin sheets along the length and width; and a ceramic felt disposed between the core panel means and one of the facing skin sheets, and coextensive with the respective facing skin sheet along the length and width thereof.

In some versions, and wherein the skin sheets are noncombustible and the panel is susceptible, if the core panel means is not protected, of failing to provide a one-hour fire rating if constructed without the ceramic felt element, the failure susceptibility being primarily a function of the combustibility of the core panel means, such as where the core panel means is fiberglass or foam. The ceramic felt provides protection to such core panel means whereby the fire rating is improved. In some versions, the resulting building panel can meet the requirements for a one-hour fire rating.

The bridge girt assemblies disclosed herein can be used as desired, in making the modular building panels of this third embodiment.

In a fourth embodiment, the invention comprehends a modular building panel comprising a pair of facing skin sheets arranged with adjacent edges generally extending parallel to one another, the facing skin sheets being spaced from each other by spacing means interposed and secured between the facing skin sheets, the spacing means including a plurality of noncompressible ceramic spacers adapted to withstand sufficient compression to secure them in position between the facing skin sheets, such as the above 32 foot pounds of torque on standard coarse thread machine bolts.

Preferably, the skin sheets consist essentially of noncombustible material, and the building panel includes core panel means disposed in the space between the facing skin sheets, the core panel means consisting essentially of material having sufficient fire retardant properties that the building panel has at least a one-hour fire rating.

In some versions of this fourth embodiment, the core panel means, too, consists essentially of noncombustible materials, whereby the modular building panel is noncombustible.

In a fifth embodiment, the invention comprehends a modular building panel comprising a pair of facing skin sheets arranged with adjacent edges generally extending parallel to, and spaced apart from, one another, and defining a length and a width and a space between the facing skin sheets; and core panel means in the space between the facing skin sheets, and generally coextensive with the facing skin sheets along the length and width, the core panel means comprising a nonmetallic, and nonsheet glass, bullet-proofing layer generally coextensive with the facing skin sheets and adapted to stop projectiles from small arms gunfire, whereby the modular building panel is bullet-proof.

The modular building panels of this fifth embodiment preferably include bridge girt assemblies comprising first and second noncombustible, elongate brace members, each elongate brace member having an outer leg secured to one of the facing skin sheets, and web means extending from each outer leg toward the other brace member; and noncombustible, thermally insulating spacing means secured between the webs of the elongate brace members; the noncombustible, thermally insulating spacing means providing a thermal break between, and along the respective lengths of, the first and second elongate brace members. The ceramic spacers are preferably secured between the webs of the elongate brace members by connectors having negligible thermal insulating value, and washers are disposed between the connectors and the webs of the brace members, the washers being thermally insulating and noncombustible, and being compressible when assembled into the bridge girt assembly. Where the skin sheets consist essentially of noncombustible materials, the modular building panel is both bullet-proof and noncombustible. Where the core panel means also includes an insulating board generally coextensive with the skin sheets between the bridge girt assemblies, the modular panel also provides thermal insulation. Preferably, the insulating board is noncombustible, whereby the noncombustible properties of the modular panel can be achieved.

The invention further comprehends buildings made with all the above modular building panels including use of these panels as walls, floors and roofs.

BRIEF DESCRIPTION OF THE DRAWINGS

The preferred exemplary embodiments of the present invention will hereinafter be described in conjunction with the appended drawings, where like designations denote like elements; and:

FIG. 2 is an exploded view of the bridge girt assembly.

FIG. 3 is a fragmentary cross-section of the modular building panel taken at 3—3 of FIG. 1 and showing a cross-section of the bridge girt assembly.

DETAILED DESCRIPTION

Figure 1:
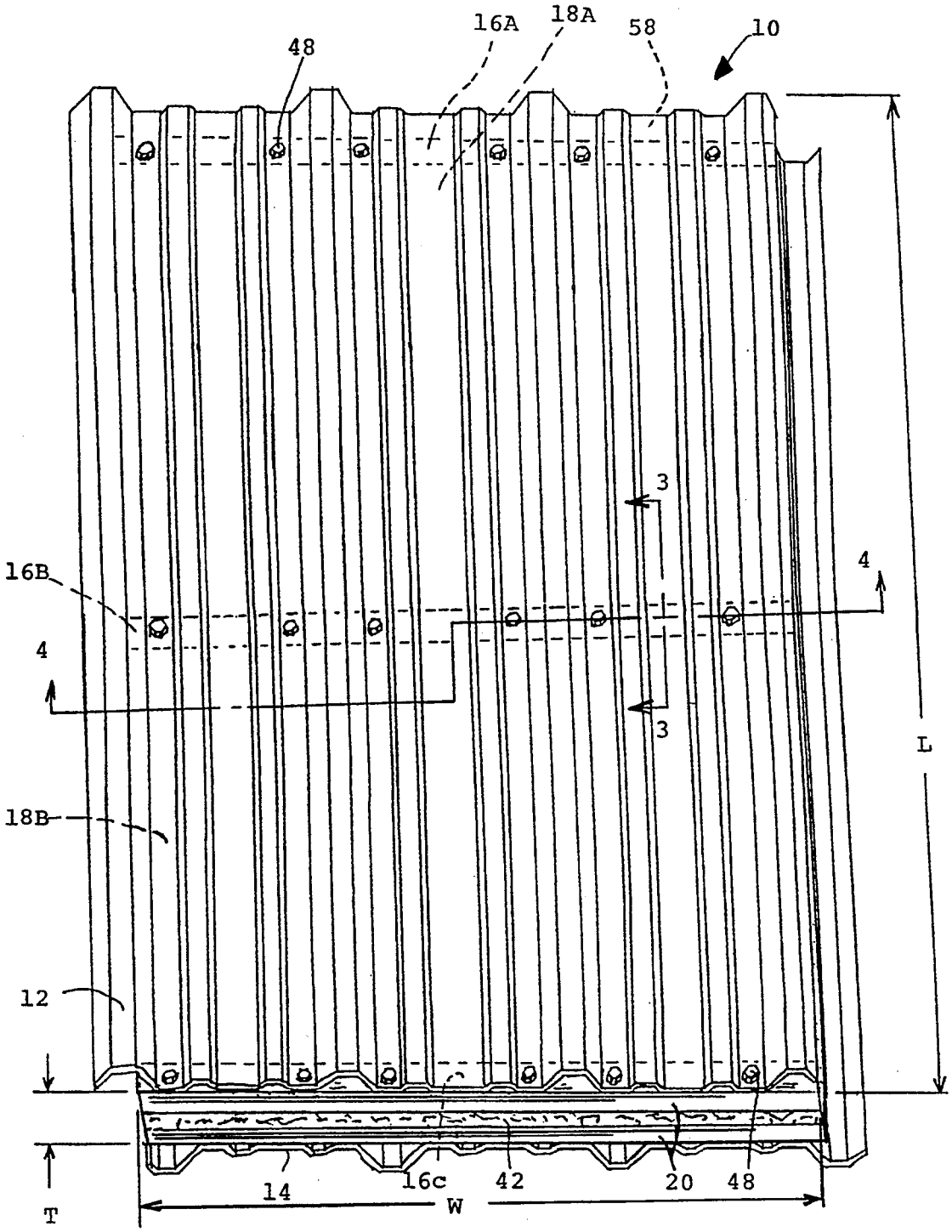
FIG. 1 is a pictorial view of a modular building panel of this invention.

Referring now to FIG. 1, the modular building panel 10 has a length "L," a width "W," and a thickness "T," and generally comprises an outer skin sheet 12, an inner skin sheet 14, and a plurality of bridge girt assemblies 16 extending across the width "W" of the panel. A first core panel member 18A is disposed between inner and outer skin sheets 12 and 14 and between bridge girt assemblies 16A and 16B. A second core panel member 18B is disposed between inner and outer skin sheets 12 and 14 and between bridge girt assemblies 16B and 16C. Preferably, the core panel members 18 are lightly compressed between inner and outer skin sheets 12 and 14, whereby modest expansive restorative forces in the core panel members push outwardly against inner and outer skin sheets 12 and 14, and, thus, fix the core panel members in position.

As seen in FIGS. 2 and 3, each bridge girt assembly 16 comprises a pair of elongate C-shaped channel braces 20, which are preferably constructed of metal. Each channel brace has an outer leg 22, and a web 23. As illustrated, each web 23 comprises an inner leg 24, a back wall 25, and a lip 26 opposite back wall 25. The inner leg 24 and the outer leg 25 extend away at right angles from the same side of the back wall 25 and are substantially parallel to each other. The channel braces 20 are bolted together by bolts 28, nuts 30, and metal washers 32, through holes 34 in inner legs 24. The inner legs 24 of each of the channel braces 20 are in registration with one another. Thermally insulating washers 35 are disposed between washers 32 and legs 24 of the respective braces 20. Thermally insulating spacers 36, preferably ceramic, are interposed between the channel braces 20 at each bolt 28.

L-Grade steatite insulators, for example grade L-3A, available from DU-CO Ceramics Company, Saxonburg, Pa. are suitable as spacers 36. Typical such spacers are, for example, 1.173 inches outside diameter and 0.5 inch thick, and have a 0.5-inch diameter hole. The grade L-3A steatite insulator has a tensile strength of 8,000–12,000 pounds per square inch and a compression strength of 70,000–90,000 pounds per square inch.

Thermally insulating washers 35 are made using, for example, a wet ceramic felt which is flexible when wet, and which forms a more rigid/less flexible mat when dry. A suitable such wet ceramic felt is available as RPC-2300-W, available from Refractory Products Company, Elgin, Ill. The felt is kept wet, and therefore flexible, until installed in the position shown in FIG. 3, between conventional metal washer 32 and the leg 24 of the brace 20. As the nut 30 is tightened on bolt 28 and washer 32, the felt under washer 32 is compressed, and is thereby deformed around the outer edge of washer 32 as shown; and is also similarly deformed into the hole 34, whereby the felt is thus disposed between bolt 28 and the edge of the hole 34. The deformed wet ceramic felt thus is disposed, and acts, much like a grommet which is set into a hole so as to protect the inner circumference of the hole. When the wet ceramic felt dries in the bridge girt assembly, it generally holds its shape, thus becoming washer 35. The resulting felt washer 35 is noncombustible, being ceramic, and provides thermal insulation between the brace 20 and the bolt, nut, and washer, 28, 30, 32. Similarly-operative textile ceramic material is also likely useful, and operative embodiments thereof are included herein within the definition of the thermally insulating, noncombustible washer 35.

The combination of thermally insulating washers 35 and thermally insulating spacers 36 thus advantageously provides an effective thermal break between the channel braces 20, and accordingly between the inner and outer skin sheets 12 and 14.

A second advantageous property of the bridge girt assembly 16 is that all of its elements (namely the channel braces 20, spacers 36, bolts 28, nuts 30, and washers 32 and 35) are noncombustible, whereby the rib assembly in its entirety is noncombustible.

A third advantage of bridge girt assembly 16 is that its elements can be combined in a variety of sizes and strengths. Accordingly, the bridge girt assembly, and cooperatively the modular building panel made with it, can be made as strong as desired by specifying the strengths of the several components, and can be made thick or thin (dimension "T"), as desired.

Figure 5:
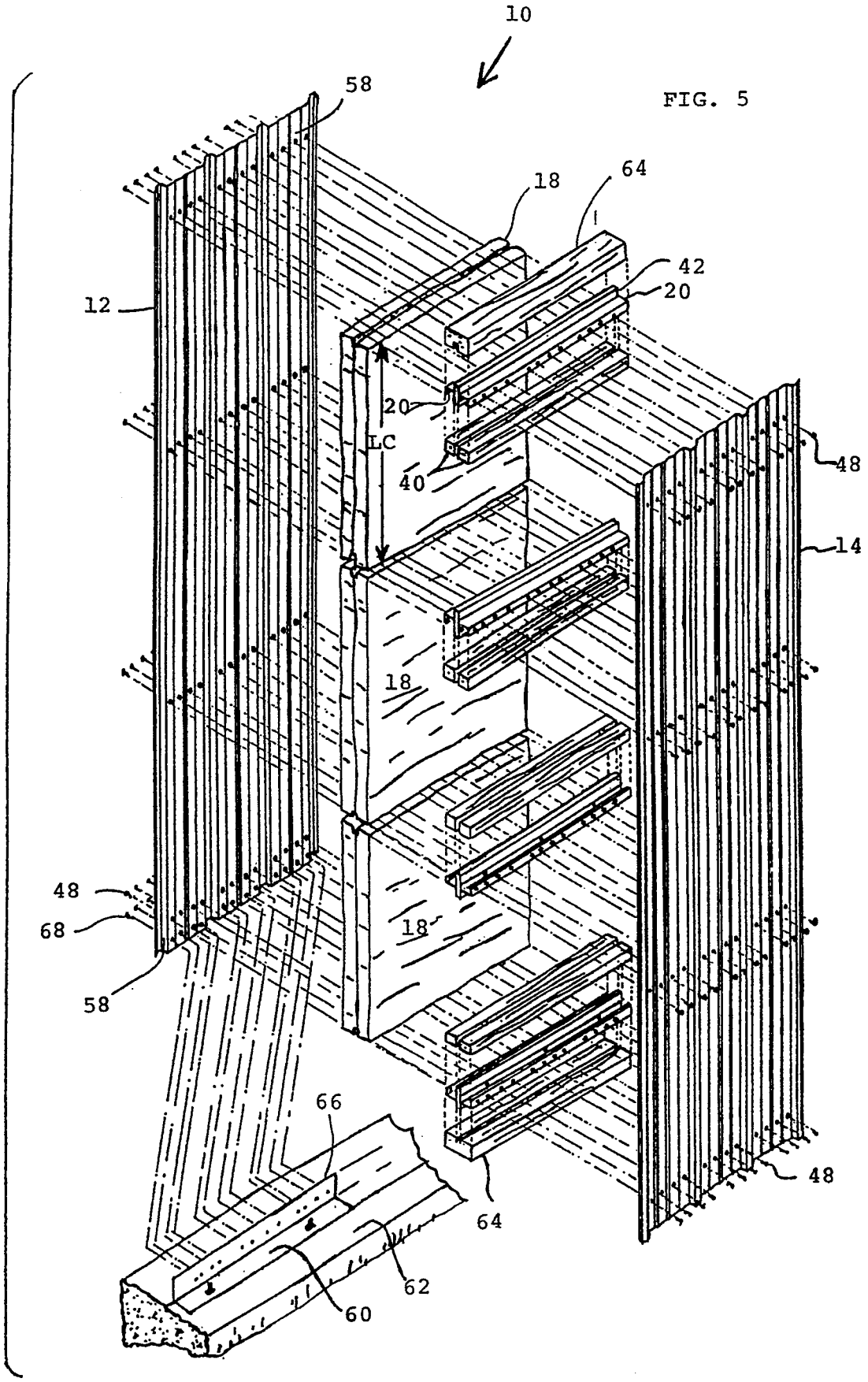
FIG. 5 is an exploded view of a modular building panel, and a fragment of a building foundation.

Each channel brace 20 is preferably filled with a cooperatively shaped block 40 of insulating material which is preferably lightly compressed. Another cooperatively shaped block 42 of the insulating material receives spacers 36 as shown, and is disposed between the inner surfaces of inner legs 24 of the channel braces 20. The core panel members 18 generally fill the spaces between the inner and outer skin sheets, and the bridge girt assemblies. As illustrated in FIGS. 3 and 5, the core panel members 18 are lightly compressed into, and fill, the spaces between the bridge girt assemblies, conforming to internal surface irregularities, especially at the rib assemblies.

The core panel members 18 and the insulating blocks 40 and 42 provide the primary insulating properties of the wall panels 10. Mineral wool, because of its noncombustible property, is the preferred material for the core panel members 18 and insulating blocks 40 and 42. A variety of insulating mineral wool products are available, and can be selected for their differing properties as desired. Illustrative of suitable mineral wool products are the panels sold as Rocboard TM by Partek Insulation Inc., Sarnia, Ontario, Canada. Such boards have 100% recovery after 10% compression, whereby their recovery properties are readily used to fix and hold the boards in position as core panel members 18, as described above.

Another mineral wool product is the bulk ceramic fiber sold as Kaowool TM by Thermal Ceramics, Inc., Augusta, Ga. These and similar mineral-derived fibrous products are included in the term "mineral wool."

As used herein, throughout, including in the claims, the term "noncombustible" means that the primary structure being addressed will not burn under ordinary building casualty-fire conditions, whereby the structural integrity of the structure addressed is not reduced in an ordinary building casualty fire. Coatings such as paint or anti-rust coatings and the like may burn, but their burning typically adds only a little fuel and does not imperil the structural integrity of the assembly. Of course, where a building is being addressed, other components of the building not related to the modular building panels are not being addressed.

As used herein, throughout, including in the claims, the term "one-hour rated" means a material or structure which passes the burning test set forth in ASTM E-119.

As used herein, the term "bullet proof" as related to a wall panel means that the wall panel prevents penetration, through both skin sheets, of ballistic projectiles having the penetrating power of a .44 magnum caliber handgun fired at close range.

As used herein, the term "nonmelting" refers to a panel whose components do not melt under the conditions to which the panel is exposed when tested according to ASTM E-119, and which panel maintains its integrity under those conditions.

Generally, the test conditions of ASTM E-119, as referred to herein, provide heat, in a furnace, on one side of the building panel, at a scheduled rate of increase in temperature. When the opposing skin reaches 250° F. (in at least one hour, and up to eight hours), the panel is pulled out of the furnace. A stream of water from a pipe generally 2.5 inches diameter, equipped with 1,125-inch tip, at 30–45 pounds per square inch gauge pressure is then impinged on the burned side of the panel from about 20 feet away. If water penetrates the skin on the unburned side of the panel, namely demonstrating burn-through of the entire thickness of the panel, the panel fails the test. If water does not penetrate the skin on the unburned side, the panel passes the test, and is rated according to the amount of time the panel was subjected to the fire in the furnace before the side disposed away from the heat reached 250° F. Of course, if the panel members or components melt, integrity of the panel is not maintained, and the panel, accordingly, fails the test.

The amount of thermal resistance provided by the wall panels 10 is generally determined by the thickness of the core panel members 18. The preferred Rocboard TM material has an insulating value of R4 per inch thickness at the typically preferred density of 4 pounds per cubic foot. It is available in thicknesses from 1 to 5 inches, in 0.5-inch increments and a variety of densities. Typical core panel members 18 are between two and eight inches thick. So a wall panel having a core member 5 inches thick, having two Rocboard TM panels each 2.5 inches thick, density 4 pounds per cubic foot, and constructed as illustrated in the drawings (e.g., FIG. 5), with the bridge girt assemblies positioned 4 feet apart, has a theoretical insulating value of R20, assuming that the insulating value of the bridge girts is the same as the insulating value of the Rocboard TM. Allowing a lesser insulation value for the bridge girts, the modular building panel will have an R-value representing thermal resistance in the range of about R16 to about R19. Such a building panel, 3 feet wide and 20 feet long, assembled as in the illustrated embodiments, and secured with the preferred torque on bolts 28, can withstand a single span wind loading of up to at least about 88 pounds per square foot. This corresponds to a wind speed of over 200 miles per hour.

The thicknesses of the respective bridge girt assemblies can be varied such that the bridge girt assemblies accommodate the thicknesses of the core members, by using different size C-channels.

The cross-sectional shapes and thicknesses of braces 20 are not critical so long as the braces provide structural web 23 members corresponding at least to back walls 25, the webs extending sufficiently inwardly toward the respective opposing braces that, e.g., the webs can be used to secure the braces to each other. A preferred brace is the C-channel as shown, made with 20-gauge steel.

Inner and outer skin sheets 12 and 14 are secured to opposing outer surfaces 46 of the outer legs 22 of C-channels 20, of bridge girt assembly 16, by screws 48 which extend through the respective skin sheets and the respective ones of the outer legs 22.

Figure 4:
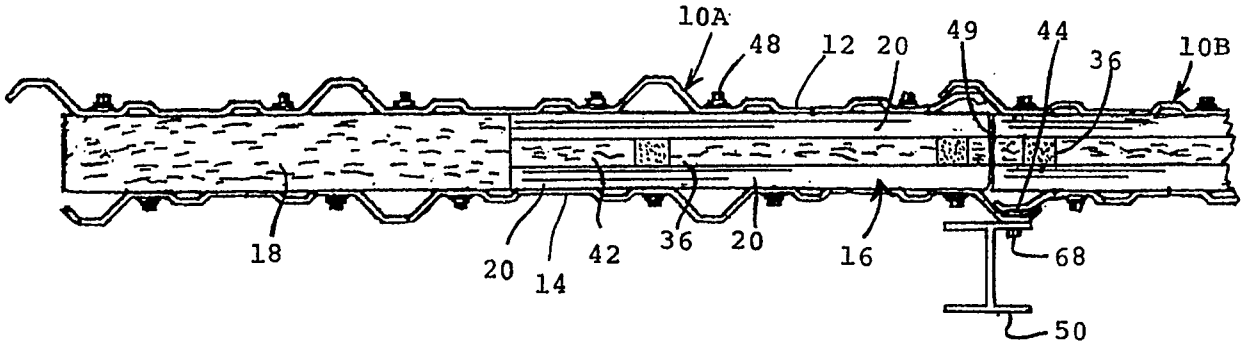
FIG. 4 is a cross-section taken at 4—4 of FIG. 1, showing the modular panel of FIG. 1 coupled to a second panel, only part of which is shown in FIG. 4.

As seen in FIGS. 1 and 4, the inner and outer skin sheets are preferably ribbed or corrugated sheet metal or the like. 26-gauge sheet steel is preferred. FIG. 4 shows the overlap of the skin sheets of adjacent panels 10A and 10B, as the skin sheets provide the main closure at the joint 49 between the adjacent panels, the joint being represented by the meeting of the core panel members 18, the bridge girt assemblies 16, and the skin sheets 12 and 14. Where the outer skin sheet 12 is to form an outer surface of the roof of a finished building, sealing tape 44 provides a seal between the overlapped skin sheet portions, as shown. However, by securing holding straps and the like (not shown) through outer skin sheet 12 to the bridge girt assemblies 16, a variety of other facing materials may be secured to the outer surfaces of the modular building panels to form the outer surface of the building; such heavy materials as brick and natural stone being included.

Inner and outer skin sheets 12 and 14 can have a variety of shapes, and can be made from a variety of materials well known in the art for surfaces of building wall panels. Thus, outer skin sheet 12 can be made with a fiberglass impregnated plastic resin, or other plastic, sprayed on cementitious mixture, and the like. The inner skin can be one of the plastics or mineral coatings, or other covering well known in the art. Where fire resistance properties are desired, as in some of the embodiments herein, noncombustible skin sheets are preferred, such as the above mentioned sheet steel.

The wall panels 10 can be made in a variety of lengths and widths by selecting different dimensions for the core panel members 18, the bridge girt assemblies 16, and the inner and outer skin sheets 12 and 14. The modular panels can also be made longer or shorter by adding or deleting sections, each section comprising a core panel member 18 and a corresponding bridge girt assembly. Inner and outer skin sheets 12 and 14 are, of course, sized accordingly. FIGS. 1 and 5 illustrate modular panels having two and three core panel members 18 respectively.

Either of skin sheets 12 or 14 can accept additional finishing layers, not shown. For example, gypsum can be used on inner skin sheet 14. Brick can be used on outer skin sheet 12 as indicated (supported by a brick ledge on the foundation). Other conventional exterior surface products can also be used on outer skin 12, such as prefabricated cementitious panels 52.

As disclosed for the illustrated embodiment, all elements of the wall panels 10 are preferably noncombustible materials. This provides a noncombustible construction, which will maintain its integrity under fire conditions. Where a one-hour fire rating is acceptable, materials having corresponding potential for burning may be used. The tolerance for burning governs the selection of materials. The selection will be obvious to those of ordinary skill in the art. Thus, in embodiments which need not be fire rated, the channel braces 20 and spacers 36 can be, for example, plastic. The core panel members, and blocks 40 and 42, can be foamed plastic. But the fire rated (at least one-hour rating) and fire proof (four-hour rating) constructions are preferred. Fire resistance requirements are thus considered when the components of the modular building panel are selected.

Figure 6:
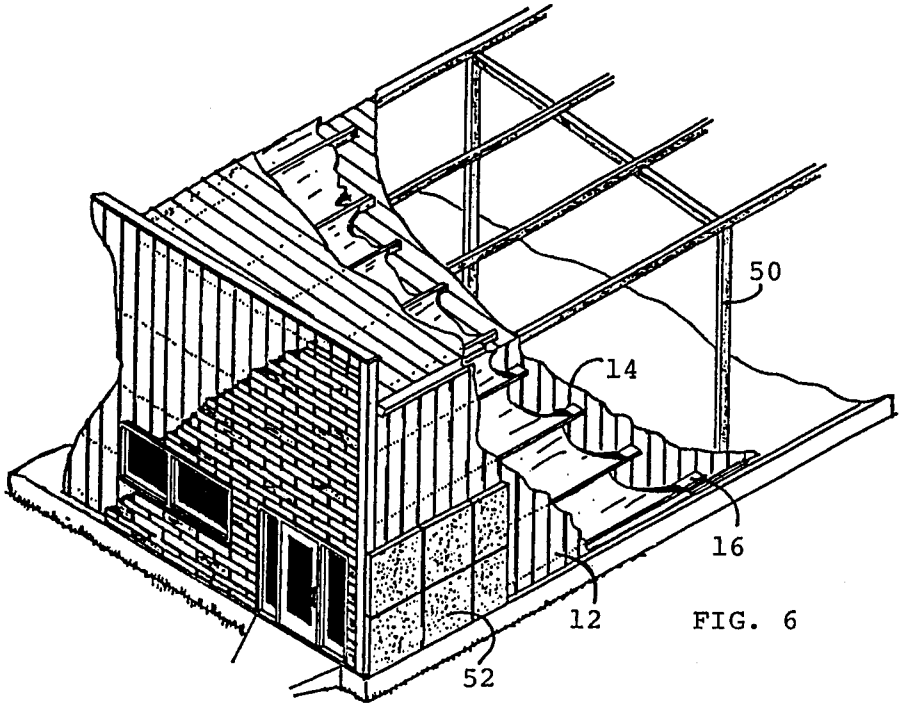
FIG. 6 is a pictorial view of a fragment of a building, with parts cut away, made with modular building panels of this invention.

As illustrated in FIG. 6, the modular building panels disclosed herein can be used in either vertical or horizontal orientations, and at any angle in between.

End caps 54 and braces 56 are used as needed in channel braces 20 for increased structural rigidity and support in the bridge girt assemblies. The end caps 54 can also be used as closures for bridge girt assemblies that form ends of walls or wall surfaces in the building.

Referring now to FIGS. 2 and 3, the bridge girt assembly is assembled as follows. Braces 56, if used, are inserted into channel braces 20, as illustrated in FIG. 2, and are secured in place by screws, pop rivets or the like. Spacers 36 are inserted into the holes in insulation block 42. Legs 24 of the braces 20 are positioned on opposing sides of insulation block 42 and, correspondingly, on opposing ends of the spacers 36, with the respective holes 34 in the legs 24 aligned with each other and with the holes in spacers 36. Standard coarse-thread machine bolts (preferably grade 5) are fitted with washers 32. Ceramic felt material, preferably including a properly punched hole for receiving bolt 28, is placed on the bolts. The bolts, with the two washers, are inserted through the holes 34 and the spacers 36. Ceramic felt material is again fitted onto the bolts, followed by metal washers 32 and nuts 30. 5/16-inch standard coarse thread bolts and nuts are preferred. As the nuts are tightened, the felt washer material is compressed and deformed around the metal washers 32 and into the holes 34 in the metal inner legs 24 of the braces 20.

The structural rigidity of the bridge girt assembly is determined, in part, by the tightening force applied at nuts 30. The tightening also encourages the flow of the flexible ceramic felt material into holes 34 and around washers 32 as discussed above. Nuts 30 are preferably tightened to a torque of 32 to 40 foot pounds, 36 foot pounds torque being preferred.

Blocks 40 of insulating material, preferably the same composition as core panel members 18, are then inserted into the braces, in the positions shown in FIG. 3. End caps 54 are then inserted, if used. The bridge girt assembly 16 is thus complete and ready for use in a modular building panel.

With reference to FIGS. 1, 3, and 5, the assembly of a modular building panel is now illustrated, assuming that the assembling of the bridge girt assemblies has been completed. First the bridge girt assemblies are secured, at their outer surfaces 46, to one of the skin sheets 12 and 14 using screws 48; leaving space to receive the core panel members 18 between the bridge girt assemblies when the core panel members are lightly compressed along their lengths "LC" (e.g. up to about 10% of the length). The core panel members 18 are then positioned in the spaces, each panel member having one of its major surfaces disposed against the respective skin sheet. The opposing edges of the core panel member are disposed against the respective bridge girt assemblies. The compression of the resilient core panel members when they are inserted into the space causes the core panel members to exert a modest expansive restorative force against the bridge girt assemblies (see FIG. 3) whereby the core panel member 18 is deformed/conformed about any irregularities in the corresponding surface of the bridge girt assembly. Note in FIGS. 3, 7, and 8, how the core panel members 18 conform especially to block 42, whereby the core panel members are readily fixed in position. With the core panel members in position, the second skin sheet is placed over the combination of the bridge girt assemblies and the core panel members, and secured to the bridge girt assemblies using more screws 48. This completes the assembly of the modular panel prior to shipping to the building site. Spaces 58 are disposed between the ends of the panel and the outermost bridge girt assemblies in FIG. 5. Spaces 58 are filled with blocks of insulation 64 at the building site.

At the building site, an angle iron adapter 60 or the like is secured to the building foundation 62. Just prior to installation of the modular panel on the building, insulation blocks 64 are placed into spaces 58. With blocks 64 in place, the modular panel 10 is set into place on the adapter 60, with the upper edge 66 of the adapter between inner and outer skin sheets 14 and 12, and adjacent one of the skin sheets, preferably between outer skin sheet 12 and the lower insulation block 64. Screws 68 are then installed through the adjacent skin sheet (skin sheet 12 in the drawings) and adapter 60 at the base of the panel (FIG. 5) and through inner skin sheet 14 and structural members 50 (FIG. 4). This secures the modular building panel to the building.

Each core panel member 18 can be comprised of a single block of material (e.g., Rocboard TM), or can be two layers, as shown in FIG. 5, or more.

Figure 7:
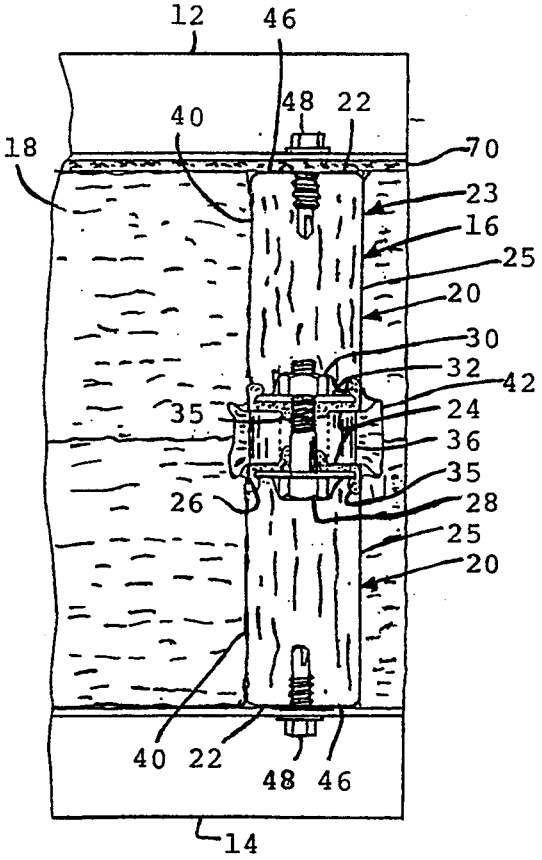
FIGS. 7 and 8 are fragmentary cross-sections as in FIG. 3, showing exemplary optional structuring on the interior of the modular building panels.

In FIG. 7, a layer 70 of noncombustible insulation is placed between the inner skin sheet 12 and the core panel member 18 and is coextensive with the inner skin sheet. The wet ceramic felt material (e.g., RPC 2300-W) used for washers 35 is a suitable material. Ceramic textiles may also be used. This construction, using a noncombustible layer, can be advantageous when a more combustible material such as fiberglass or a polymeric foam composition is selected for use in the core panel member 18. Layer 70 serves as a fire shield to protect the core panel member, whereby the fire resistance of the overall modular building panel may be improved.

Figure 8:
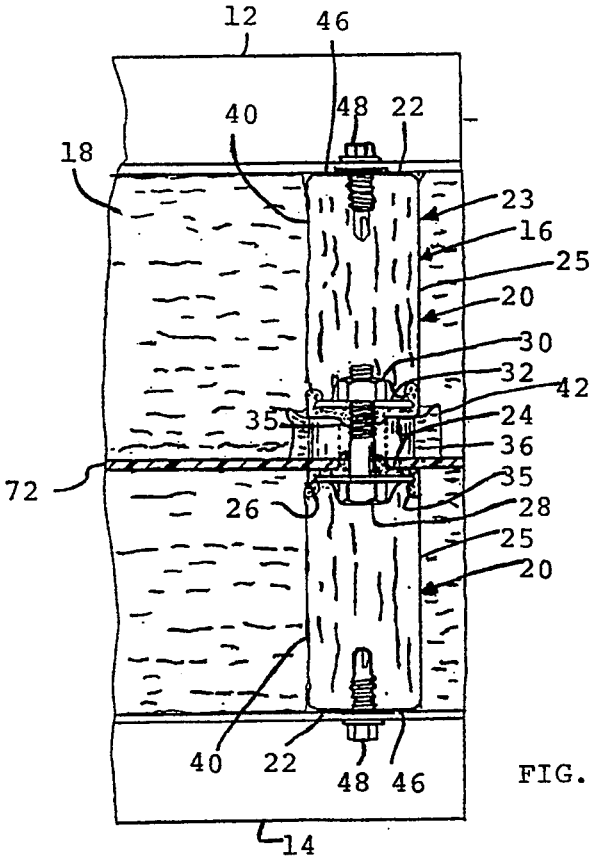

In FIG. 8, a bullet-proofing layer 72 of a nonmetallic, preferably polymeric, bullet-proofing material is secured between ceramic spacers 36 and the inner legs 24 on the braces 20 on one side of the spacers 36. Bullet-proof metal sheet or glass sheet are not used because they are heavy and more difficult to work with. The layer 72 may contain glass and/or metallic components, but not as continuous phase coextensive with the layer such that the continuous phase provides, by itself, the primary bullet-proofing property. So, as used herein, "nonglass" means not glass as a continuous phase. Accordingly, "nonglass" excludes from layer 72 conventional plate glass and sheet glass as ordinarily associated with bullet-proof glass installations. Similarly, "nonmetallic" means not metal as a continuous phase. Accordingly, "nonmetallic" excludes from layer 72 conventional metal plate strong enough to prevent ballistic penetration. However, "nonglass" and "nonmetallic" does not exclude from layer 72 a metal layer or a glass layer of lesser barrier property as one of a plurality of layers in a multiple layer barrier corresponding to layer 72, which lesser metal and glass layers are hereby included in the definition of layer 72 as a bullet-proof layer where layer 72 comprises a plurality of layers. From the above, it can be seen that layer 72 may comprise a multiple layer structure having a plurality of sub-layers joined to each other, generally in face-to-face relationship, and which sub-layers act, in combination, to provide the bullet-proof property.

A variety of suitable bullet-proofing materials are known, such as Kevlar TM and the like. Kevlar TM aramid fiber is a trademark of DuPont for aromatic polyamide polymer fiber, poly(1,4-phenyleneterephthalamide). Such materials are light-weight, and are suitable for stopping small arms gunfire, whereby the entire building made with such building panels can be made bullet proof. Layer 72 can readily be located elsewhere in the panel structure, if desired, such as between outer skin sheet 14 and the core panel member 18.

In a combination modular building panel, the bullet-proofing layer 72 can be used in combination with insulating mineral wool core panel members 18 and noncombustible bridge girt assemblies. The resulting modular panels are both noncombustible and bullet proof. The bullet-proofing layer can also be used with the embodiment of FIG. 7, comprising the overall ceramic layer, whereby the core panel member 18 is generally not noncombustible, and perhaps not fire rated, but is protected by noncombustible layer 70. These structures, too, offer both bullet resistance and resistance to fire.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A bridge girt assembly for use within a modular building panel to provide mechanical reinforcing to said panel and to provide structural integrity to said panel during fire conditions, said bridge girt assembly comprising:

(a) first and second noncombustible, nonmelting elongate brace members, each said elongate brace member being substantially C-shaped cross section having an outer leg, an inner leg opposite said outer leg and a back wall disposed between said outer leg and said inner leg, said outer leg having an outer surface, said outer surface configured to receive a modular building panel skin sheet thereon, said inner legs of said elongate brace members parallel with one another and spaced from one another; and (b) noncombustible, nonmelting, thermally isolating spacing means for providing an effective thermal break between said first and second elongate brace members during fire conditions, said spacing means having a portion defining an opening for accepting a fastening means; and (c) fastening means for securing said spacing means between said inner legs of said first and second elongate brace members, said fastening means thereby securing said first and second elongate brace members.

2. A bridge girt assembly as in claim 1 wherein said spacing means is substantially noncompressible along the dimension thereof extending between said inner legs.

3. A bridge girt assembly as in claim 1, said spacing means comprising a plurality of spacers disposed at spaced locations along the lengths of said first and second elongate brace members and between said inner legs.

4. A bridge girt assembly as in claim 3, wherein said fastening means comprise standard coarse-thread machine bolts and wherein said spacers are noncompressible ceramic spacers having a compressive strength sufficient to withstand compressive force applied to said spacers by applying a torque of 36 foot pounds on to said machine bolts and using the torque applied to said machine bolts to secure said spacers to said inner legs in said assembly by compression, whereby said bridge girt assembly maintains its integrity when said bridge girt assembly is tested according to ASTM E-119.

5. A bridge girt assembly as in claim 1, said first and second elongate brace members having substantially C-shaped cross sectional cavities extending along the respective lengths thereof, and including noncombustible insulation disposed in said substantially C-shaped cross sectional cavities.

6. A bridge girt assembly as in claim 4, said machine bolts securing said ceramic spacers between said inner legs of said elongate brace members, said machine bolts having negligible thermal insulating value, and further including washers between said machine bolts and said inner legs of said elongate brace members, said washers being thermally insulating, nonmelting and noncombustible, and being compressible when assembled into said bridge girt assembly.

7. A bridge girt assembly as in claim 1 wherein said spacing means comprises a plurality of noncombustible, nonmelting thermally insulating cylindrical spacers intermittently spaced and axially secured between said inner leg of said first elongate member and said inner leg of said second elongate member.

8. A modular building panel comprising:

(a) a pair of spaced apart, facing skin sheets arranged with adjacent edges extending substantially parallel to one another, said sheets having a length and a width therebetween; and (b) a plurality of bridge girt assemblies, each said bridge girt assembly disposed therebetween said facing skin sheets and extending across the width of said facing skin sheets, and connecting said skin sheets, each said bridge girt assembly spaced from the edges defining the length of said facing skin sheets, each said bridge girt assembly comprising:

(i) first and second elongate brace members, each said elongate brace member being of substantially C-shaped cross section having an outer leg, an inner leg opposite said outer leg and a back wall disposed between said outer leg and said inner leg, said inner leg and said outer leg extending away at right angles from the same side of said back wall and substantially parallel to each other, said outer leg having an outer surface, said outer surface configured to receive a facing skin sheet thereon, said inner legs disposed toward the respective opposing brace member to permit the first and second brace members to be secured to each other; and (ii) a plurality of thermally insulating cylindrical spacers, spaced from each other along the lengths of said elongate brace members and secured axially between said inner legs of said first and second elongate brace members, and thereby securing said first and second elongate brace members to each other, each said bridge girt assembly being intermittently secured at said outer surfaces of said outer legs opposite said spacers to said facing skin sheets.

9. A modular building panel as in claim 8, and including connectors, and wherein said spacers comprise ceramic spacers secured between said inner legs of said elongate brace members by said connectors having negligible thermal insulating value, and including washer means between said connectors and said inner legs of said elongate brace members, said washer means being thermally insulating and noncombustible, and being compressible when assembled into said bridge girt assembly, wherein said connectors are standard coarse-thread machine bolts and wherein said ceramic spacers have a compressive strength sufficient to withstand a compressive force applied to said ceramic spacers by applying a torque of 36 foot pounds to said machine bolts and using the torque applied to said machine bolts to secure said ceramic spacers in said assembly by compression.

10. A bridge girt assembly for use within a modular building panel to provide mechanical reinforcing to said panel, said bridge girt assembly comprising:

(a) first and second elongate brace members, each said elongate brace member being of substantially C-shaped cross section having an outer leg, an inner leg opposite said outer leg and a back wall disposed between said outer leg and said inner leg, said inner leg and said outer leg extending away at right angles from the same side of said back wall and substantially parallel to each other, said outer leg having an outer surface, said outer surface configured to receive a modular building panel skin sheet thereon, said inner legs disposed toward the respective opposing brace member to permit the first and second brace members to be secured to each other; and (b) a plurality of thermally insulating cylindrical spacers, spaced from each other along the lengths of said elongate brace members and secured axially between said inner legs of said first and second elongate brace members, and thereby securing said first and second elongate brace members to each other.

11. A bridge girt assembly as in claim 10 wherein said spacers are substantially noncompressible.

12. A bridge girt assembly as in claim 10, said bridge girt assembly further comprises standard coarse-thread machine bolts for axially securing said spacers to said inner legs of said elongate brace members wherein said spacers comprises ceramic spacers adapted to withstand compressive force applied to said spacers by applying 36 foot pounds of torque on said standard coarse-thread machine bolts and using the torque applied to said machine bolts to secure said spacers in said assembly by compression wherein a modular building panel having a 3-foot width dimension by a 20-foot length dimension and constructed with a plurality of said bridge girt assemblies having said spacers secured with said torque can withstand a single span wind loading of up to at least about 88 pounds per square foot.

13. A bridge girt assembly as in claim 10, said cylindrical spacers being secured between said inner legs of said elongate brace members by connectors having negligible thermal insulating value, and including washer means between said connectors and said inner legs of said elongate brace members, said washer means being thermally insulating and noncombustible, and being compressible when assembled into said bridge girt assembly.

14. A building comprising:

(a) a plurality of modular building load bearing panels, said plurality including wall panels and roof panels, each of said panels comprising (i) a pair of spaced apart, facing skin sheets arranged with adjacent edges extending substantially parallel to one another, and having a length and a width;

(ii) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly comprising: (A) first and second elongate brace members, each said elongate brace member having an outer leg having an outer surface, said outer surface configured to receive a facing skin sheet thereon, and a web extending from each said outer leg toward the other said elongate brace member, said web further having a back wall and an inwardly extending web portion extending sufficiently inward toward the respective opposing brace member to permit the first and second brace members to be secured to each other; and (B) a plurality of thermally insulating spacers, spaced from each other along the lengths of said elongate brace members and secured between said webs, and thereby securing said first and second elongate brace members to each other, said thermally insulating spacers, as assembled in said bridge girt assembly, providing a thermal break between said first and second elongate brace members, said bridge girt assembly being intermittently secured at said outer surfaces of said outer legs opposite said spacing means to said facing skin sheets, (b) a structural member for forming a modular building frame, said structural member adjacent one of said facing skin sheets and secured to said facing skin sheet; and (c) an adapter secured to a modular building foundation, said adapter having an upper edge, said upper edge of said adapter disposed between said pair of facing skin sheets and adjacent one of said facing skin sheets, said adapter secured to said adjacent facing skin sheet;

wherein said wall panels are disposed vertically on said adapter, said wall panels having said bridge girt assemblies substantially parallel to said adapter, and said roof panels spanning certain of said wall panels and being supported by said wall panels and by said structural member.

15. A building as in claim 14, further having at least one load bearing panel wherein said spacers comprise ceramic spacers secured between said webs of said elongate brace members by connectors having negligible thermal insulating value, and including washer means between said connectors and said webs of said elongate brace members, said washer means being thermally insulating and noncombustible, and being compressible when assembled into said bridge girt assembly, said connectors are coarse-thread machine bolts, said ceramic spacers adapted to withstand compressive force applied to said spacers by applying 36 foot pounds of torque on said machine bolts and using the torque applied to said machine bolts to secure said spacers in said bridge girt assembly by compression.

16. A modular building panel comprising:

(a) a pair of spaced apart, nonmelting facing skin sheets arranged with adjacent edges extending substantially parallel to one another, and having a length and a width; and (b) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly comprising:

(i) first and second noncombustible, nonmelting elongate brace members, each said elongate brace member being of substantially C-shaped cross section having an outer leg, an inner leg opposite said outer leg and a back wall disposed between said outer leg and said inner leg, said outer leg having an outer surface, said outer surface receiving one of said facing skin sheets thereon, said inner legs of said elongate brace members parallel with one another and spaced from one another; and (ii) noncombustible, nonmelting thermally isolating spacing means for providing an effective thermal break between said first and second elongate brace members during fire conditions, said spacing means having a portion defining an opening for accepting a fastening means; and (iii) fastening means for securing said spacing means between said inner legs of said first and second elongate brace members, said fastening means thereby securing said first and second elongate brace members;

each said bridge girt assembly being intermittently secured at said outer surfaces of said outer legs opposite said spacing means to said facing skin sheets, wherein said panel maintains its integrity when tested under ASTM E-119 conditions.

17. A modular building panel as in claim 16, further comprising a core panel member disposed therebetween said facing skin sheets, and substantially coextensive with said facing skin sheets along said length and width and disposed between a pair of said bridge girt assemblies.

18. A modular building panel as in claim 16, said spacing means comprising a plurality of spacers disposed at spaced locations along the lengths of said first and second elongate brace members and between said inner legs.

19. A modular building panel as in claim 18, wherein said fastening means comprise standard coarse-thread machine bolts and, wherein said spacers are noncompressible ceramic spacers having a compressive strength sufficient to withstand compressive force applied to said spacers by applying a torque of 36 foot pounds to said machine bolts and using the torque applied to said machine bolts to secure said spacers to said inner legs in said assembly by compression.

20. The modular building panel of claim 16, wherein said facing skin sheets are fabricated of a corrugated sheet metal having longitudinally ribbed portions, and each said bridge girt assembly is disposed substantially perpendicular to said ribbed portions.

21. A modular building panel as in claim 16, said thermally isolating spacing means comprises a plurality of noncompressible ceramic spacers, said facing skin sheets comprises noncombustible material, and said core panel member comprises material having sufficient fire retardant properties such that said modular building panel has at least a one-hour fire rating.

22. A modular building panel as in claim 16, said fastening means comprises coarse-thread machine bolts, said thermally isolating spacing means comprises a plurality of noncompressible ceramic spacers being able to withstand a compressive force applied by applying 36 foot pounds of torque on said standard coarse-thread machine bolts used to secure said spacers in said modular building panel, said skin sheets comprises noncombustible material, and said core panel member comprises material having sufficient fire retardant properties such that said modular building panel has at least a one-hour fire rating.

23. A modular panel as in claim 16, said core panel member comprises a light-weight, nonmetallic, nonglass, bullet-proofing layer generally coextensive with said facing skin sheets, for stopping projectiles from small arms gunfire, said bullet-proofing layer secured between said spacing means and said inner leg of one of said elongate brace members, whereby said modular building panel is bullet-proof.

24. The modular building panel of claim 23, wherein the bullet-proofing layer comprises an aramid fiber.

25. A modular building panel as in claim 23 said core panel member also comprises a thermally insulating board generally coextensive with said facing skin sheets and disposed between said bridge girt assemblies, whereby said modular building panel provides thermal insulation corresponding to at least R2 per inch thickness of said thermally insulating board.

26. A modular building panel as in claim 23, said core panel member and said facing skin sheets comprises noncombustible materials, whereby said modular building panel is both bullet-proof and noncombustible.

27. A modular building panel as in claim 26, said spacing means comprises thermally isolating, noncompressible ceramic spacers, said fastening means comprises connectors, said ceramic spacers being secured between said inner legs of said elongate brace members by said connectors having negligible thermal insulating value, and including washer means between said connectors and said inner legs of said elongate brace members, said washer means being thermally insulating and noncombustible, and being compressible when assembled into said bridge girt assembly.

28. A modular building panel as in claim 26, said core panel member also comprises a noncombustible, thermally insulating board generally coextensive with said facing skin sheets and disposed between said bridge girt assemblies, whereby said modular building panel also provides thermal insulation corresponding to at least R2 per inch thickness of said thermally insulating board.

29. The modular building panel of claim 17, wherein said facing skin sheets are fabricated of a corrugated sheet metal having longitudinally ribbed portions, and each said bridge girt assembly is disposed substantially perpendicular to said ribbed portions.

30. A modular building panel as in claim 17, said noncombustible, nonmelting thermally isolating spacing means comprising a plurality of spacers disposed at spaced locations along the lengths of said first and second elongate brace members, said fastening means comprising connectors securing said ceramic spacers between said inner legs of said elongate brace members, said connectors having negligible thermal insulating value, and further including washers between said connectors and said inner legs of said elongate brace members, said washers being thermally insulating and noncombustible, and being compressible when assembled into said bridge girt assembly, said connectors are standard coarse-thread machine bolts, wherein, said spacers are noncompressible ceramic spacers having a compression strength sufficient to withstand compressive force applied to said spacers by applying a torque of 36 foot pounds to said machine bolts and using the torque applied to said machine bolts to secure said spacers to said inner legs in said assembly by compression.

31. A modular building panel as in claim 30, wherein said core panel member is a thermally insulating core panel member, said modular building panel providing thermal insulation corresponding to at least R2 per inch thickness of said thermally insulating core panel member.

32. A modular building panel as in claim 30 wherein said core panel member and said skin sheets are noncombustible materials, and said modular building panel is noncombustible.

33. A noncombustible modular building panel as in claim 32, said modular building panel having an overall insulating value of at least R3 per inch thickness of said core panel member.

34. A building comprising:

(a) a plurality of modular building load bearing panels, said plurality including wall panels and roof panels, each of said panels comprising (i) a pair of spaced apart, facing skin sheets arranged with adjacent edges extending substantially parallel to one another, and having a length and a width;

(ii) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly including (A) first and second noncombustible, elongate brace members, each said elongate brace member having an outer leg having an outer surface, said outer surface receiving a facing skin sheet thereon, and a web extending from each said outer leg toward the other said elongate brace member; and (B) noncombustible, thermally insulating spacing means, secured between said webs of said elongate brace members, for providing thermal insulation between said outer legs; said noncombustible thermally insulating spacing means providing a thermal break between said first and second elongate brace members, each said bridge girt assembly being intermittently secured at said outer surfaces of said outer legs opposite said spacing means to said facing skin sheets; and (b) a structural member for forming a modular building frame, said structural member adjacent one of said facing skin sheets and secured to said facing skin sheet; and (c) an adapter secured to a modular building foundation, said adapter having an upper edge, said upper edge of said adapter disposed between said pair of facing skin sheets and adjacent one of said facing skin sheets, said adapter secured to said adjacent facing skin sheet;

wherein said wall panels are disposed vertically on said adapter, said wall panels having said bridge girt assemblies substantially parallel to said adapter, and said roof panels spanning certain of said wall panels and being supported by said wall panels and by said structural member.

35. A building as in claim 34, wherein at least one of said load bearing panels further comprises a core panel member, said core panel member disposed between said facing skin sheets, and substantially coextensive with said facing skin sheets along said length and width and disposed between a pair of said bridge girt assemblies; said noncombustible thermally insulated spacing means of same said one load bearing panel comprising a plurality of noncompressible ceramic spacers disposed at spaced locations along the lengths of said first and second elongate brace members, said bridge girt assembly of same said one load bearing panel further comprising connectors securing said ceramic spacers between said webs of said elongate brace members, said connectors having negligible thermal insulating value, and further including washers between said connectors and said webs of said elongate brace members, said washers being thermally insulating and noncombustible, and being compressible when assembled into said bridge girt assembly, said connectors are coarse-thread machine bolts; wherein said ceramic spacers have a compression strength sufficient to withstand compressive force applied to said spacers by applying a torque of 36 foot pounds to said machine bolts and using the torque applied to said machine bolts to secure said spacers to said webs in said assembly by compression.

36. A building as in claim 35 wherein said core panel member further comprises a thermally insulating material, providing thermal insulation corresponding to at least R2 per inch thickness of said core panel member.

37. A building as in claim 35, wherein said core panel member and said skin sheets comprise noncombustible materials, whereby same said load bearing panel is noncombustible.

38. A building as in claim 37, wherein same said load bearing panel has an overall insulating value of at least R3 per inch thickness of said core panel member.

39. A building as in claim 34 wherein at least one load bearing panel further comprises a core panel member in said space between said facing skin sheets, and generally coextensive with said facing skin sheets along said length and width, said core panel member comprises a light-weight, nonmetallic, nonglass, bullet-proofing layer generally coextensive with said facing skin sheets, for stopping projectiles from small arms gunfire, whereby at least one said load bearing panel is bullet-proof.

40. A building as is claim 39, wherein said core panel means and said skin sheets comprise noncombustible materials, whereby at least one load bearing panel is both bullet-proof and noncombustible.

41. A building as in claim 40, wherein said spacing means in same said load bearing panel comprises thermally insulating noncompressible ceramic spacers, said ceramic spacers being secured between said webs of said elongate brace members by connectors having negligible thermal insulating value, and including washer means between said connectors and said webs of said elongate brace members, said washer means being thermally insulating and noncombustible, and being compressible when assembled into said bridge girt assembly of same said load bearing panel.

42. A building as in claim 40, wherein said core panel member also comprises a noncombustible, thermally insulating board generally coextensive with said skin sheets between said bridge girt assemblies, whereby same said load bearing panel also provides thermal insulation corresponding to at least R2 per inch thickness of said thermally insulating board.

43. A building as in claim 39, wherein said core panel member also comprises a thermally insulating board generally coextensive with said skin sheets and disposed between said bridge girt assemblies, whereby same said load bearing panel also provides thermal insulation corresponding to at least R2 per inch thickness of said thermally insulating board.

44. A building as in claim 35, further having at least one of said load bearing panels further comprising a core panel member disposed therebetween said facing skin sheets, and substantially coextensive with said facing skin sheets along said length and width and disposed between said bridge girt assemblies, same said load bearing panel further comprising a ceramic felt disposed between said core panel member add one said facing skin sheet, and coextensive with said facing skin sheet along said length and width thereof.

45. A building as in claim 34, having at least one of said load bearing panels further comprises a core panel member disposed therebetween said facing skin sheets, and substantially coextensive with said facing skin sheets along said length and width and disposed between said bridge girt assemblies, wherein said skin sheets comprises noncombustible material, and said core panel member comprises material having sufficient fire retardant properties that said load bearing panel has at least a one-hour fire rating; said spacing means of same said load bearing panel including a plurality of noncompressible ceramic spacers.

46. A building as in claim 34, wherein at least one of said load bearing panels further comprises a core panel member disposed therebetween said facing skin sheets, and substantially coextensive with said facing skin sheets along said length and width and disposed between a pair of said bridge girt assemblies, said noncombustible thermally insulated spacing means disposed in same said load bearing panel comprising a plurality of spacers disposed at spaced locations along the lengths of said first and second elongate brace members, wherein said spacers are noncompressible ceramic spacers, said bridge girt assembly in same said load bearing panel further comprising connectors securing said ceramic spacers between said webs of said elongate brace members, said connectors having negligible thermal insulating value, and further including washers between said connectors and said webs of said elongate brace members, said washers being thermally insulating and noncombustible, and being compressible when assembled into said bridge girt assembly, said connectors are standard coarse-thread machine bolts wherein said spacers have a compression strength sufficient to withstand compressive force applied to said spacers by applying a torque of 36 foot pounds to said machine bolts and using the torque applied to said machine bolts to secure said spacers to webs in said assembly by compression; said skin sheets comprising noncombustible material, and said core panel member comprising material having sufficient fire retardant properties such that same said load bearing panel has at least a one-hour fire rating; said core panel means and said skin sheets comprising noncombustible materials, such that same said load bearing panel is noncombustible.

47. A building as in claim 34 wherein at least one load bearing panel in which each said first and second noncombustible, elongate member is a C-shaped channel brace, wherein each of said C-shaped channel braces has an outer leg, a back wall connected to said outer leg and adjacent to said outer leg, and an inner leg connected to said back wall and adjacent to said back wall, said C-Shaped channel braces disposed such that the inner leg of the first brace is spaced from the inner leg of the second brace, each said outer leg having an outer surface for receiving the facing skin sheet; and wherein said spacing means comprises a plurality of noncombustible, thermally insulating spacers intermittently spaced and secured between an inner leg of said first C-shaped channel brace and an inner leg of said second C-shaped brace.

* * * * *